United States Patent [19]

Obana

[11] Patent Number: 4,785,501

[45] Date of Patent: Nov. 22, 1988

[54] CASING PIVOTING MECHANISM FOR A COPYING MACHINE

[75] Inventor: Shigenori Obana, Yokohama, Japan

[73] Assignee: Kabushiki Kaisha Toshiba, Kawasaki, Japan

[21] Appl. No.: 125,154

[22] Filed: Nov. 25, 1987

[30] Foreign Application Priority Data

Nov. 29, 1986 [JP] Japan ..... 61-284539

[51] Int. Cl.[4] ..... E05F 1/10

[52] U.S. Cl. ..... 16/308; 16/DIG. 36; 267/154

[58] Field of Search ..... 16/308, DIG. 36; 267/154, 273, 283, 285

[56] References Cited

U.S. PATENT DOCUMENTS 2,869,959 1/1959 Kesling ..... 16/308 X 3,490,756 1/1970 Spier ..... 267/154

*Primary Examiner*—Fred A. Silverberg

*Attorney, Agent, or Firm*—Foley & Lardner, Schwartz, Jeffery, Schwaab, Mack, Blumenthal & Evans

[57] ABSTRACT

In a casing pivoting mechanism for a copying machine according to the present invention, the pivotal point of a casing is situated away from the position at which a torsion bar passes through the casing. By doing this, a greater urging force can be obtained with use of the same torsion bar as is used in a conventional mechanism. Also, the space within the casing can be widened for more effective utilization.

2 Claims, 5 Drawing Sheets

CASING PIVOTING MECHANISM FOR A COPYING MACHINE

BACKGROUND OF THE INVENTION

The present invention relates to a casing pivoting mechanism for a copying machine.

DESCRIPTION OF THE PRIOR ART

As is shown in FIG. 1, for example, a conventional casing pivoting mechanism for a copying machine has clamshell casing 1 which is provided with torsion bar mechanism 4 at mounting portions of its upper and lower casing blocks 2 and 3. Upper block 2 is swingably mounted, at one end thereof, on lower block 3. Mechanism 4 includes torsion rods 4*a* and 4*b* which intertwine at their respective central portions 4*c*. Thus, mechanism 4 serves continually to urge upper block 2 to swing up from lower block 3 by means of the restoring force generated by the torsion rods. More specifically, torsion rods 4*a* and 4*b* are mounted so that their respective opposite ends penetrate apertures 5 bored through joint portions of upper and lower casing blocks 2 and 3. End portions 4*a*1, 4*a*2, 4*b*1, and 4*b*2 of rods 4*a* and 4*b*, penetrating their corresponding apertures 5, are fitted in engagement portions 6 of upper block 2 and engagement portions 7 of lower block 3, in a manner such that the rods are twisted alternately. Fitted in each aperture 5 is coupling member 8 used to mount upper block 2 swingably on lower block 3.

However, in such a prior art casing pivoting mechanism, the twist portions at central portions 4*c* of torsion rods 4*a* and 4*b* are situated on a straight line connecting coupling members 8 which serve as the pivotal points of upper and lower casing blocks 2 and 3. With this arrangement, central portions 4*c* of rods 4*a* and 4*b* are situated in the center of the region inside lower block 3, through which cassettes and other attachments for the copying machine are inserted or removed, and thus interfere with the handling of the trays and the like. Further, such an arrangement restricts the shape and capacity of the imaging mechanism, including the trays.

SUMMARY OF THE INVENTION

The object of the present invention is to provide an improved casing pivoting mechanism for a copying machine.

In the copying machine casing pivoting mechanism according to the present invention, a second casing block is swingably coupled to a first casing block. A torsion bar is mounted between the first and second casings, so as to urge the second casing block in a predetermined direction with respect to the first casing block. The pivotal points of the first and second casing blocks are situated away from the positions at which the torsion bar passes through the casing blocks, and the torsion bar itself is formed by twisting at least two torsion rods together at their respective middle portions. The two ends of one of the torsion rods engage the first engagement portions of the first and second casing blocks, individually. Likewise, the two ends of the other torsion rod engage the second engagement portions of the casing blocks, individually.

Thus, in the casing pivoting mechanism according to the present invention, the pivotal points of the two casing blocks are situated away from the positions at which the torsion bar passes through the casing blocks. As a result, the torsion bar can be mounted on the casing blocks such that a wide internal space can be preserved between the blocks. Consequently, trays and other attachments for the copying machine can be inserted and removed easily and smoothly through this internal space. In addition restrictions as to the shape and capacity of imaging mechanism, including the trays and the like, can be eased.

Furthermore, since the pivotal points of the two casing blocks are situated away from the positions at which the torsion bar passes through the casing blocks, the urging force of the bar can be made sufficiently large.

DETAILED DESCRIPTION OF THE PREFERRED EMBODIMENTS

Figure 5:
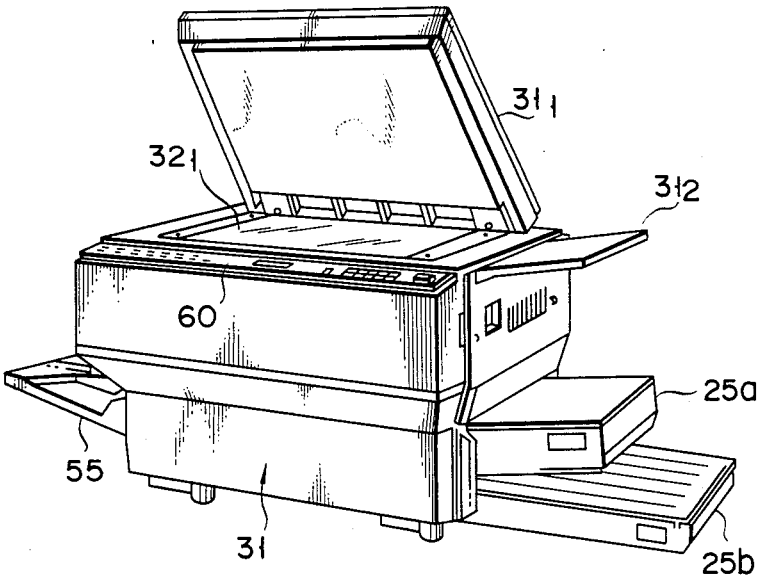
FIG. 5 is a perspective view showing an outline of a copying machine.
Figure 6:
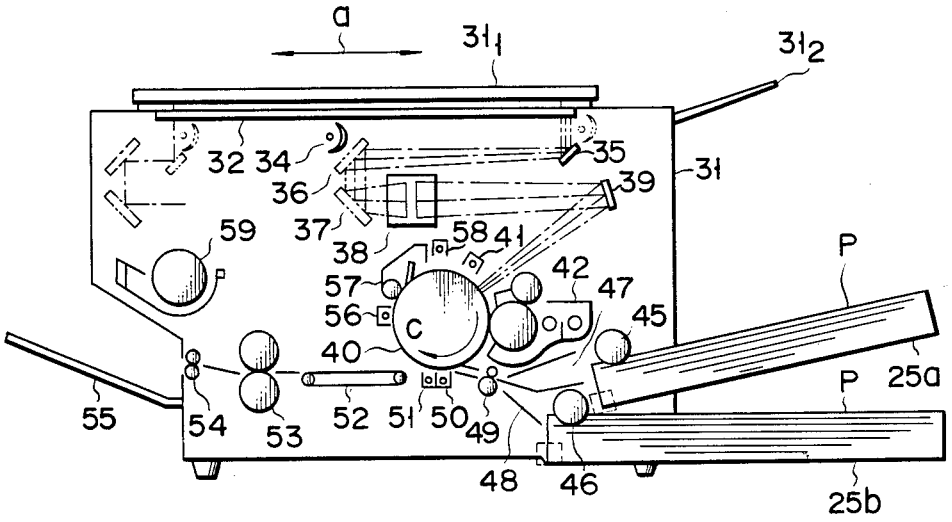
FIG. 6 schematically shows the internal construction of the copying machine.

FIGS. 5 and 6 schematically show the external appearance and internal mechanism, respectively, of a copying machine as an image forming apparatus being used in the following embodiment of the invention. Numeral 31 designates a housing of the machine. Housing 31 includes original table 32 (transparent glass plate) for supporting the original thereon. Swingable original cover $\mathbf{31}_1$ and worktable $\mathbf{31}_2$ are arranged in the vicinity of table 32. Disposed below table 32 is optical system which includes exposure lamp 34 and mirrors 35, 36 and 37 reciprocating in the direction indicated by arrow a, lens block 38 movable along the optical axis, and fixed mirror 39. As system optically scans the surface of the original, an image impression on the original is projected on the surface of photosensitive drum 40 (slit exposure). Drum 40 is rotated in the direction indicated by arrow c to have its surface charged by main charger 41, and then subjected to the slit exposure to the image impression. As a result, an electrostatic latent image corresponding to the image impression of the original is formed on the surface of drum 40. The latent image is visualized when a toner is applied to it by developing device 42.

Figure 1:
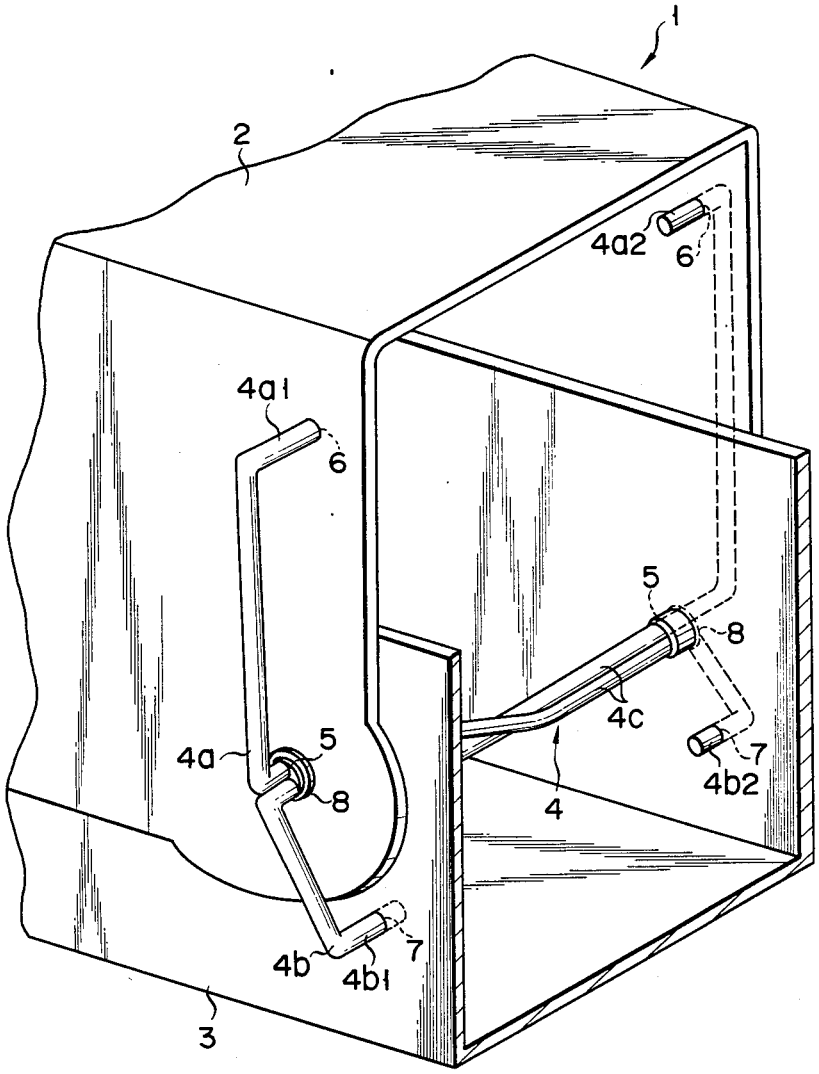
FIG. 1 (PRIOR ART)
FIG. 1 is a schematic perspective view of a prior art copying machine showing a state wherein its upper casing block is closed by means of a casing pivoting mechanism.
Figure 2:
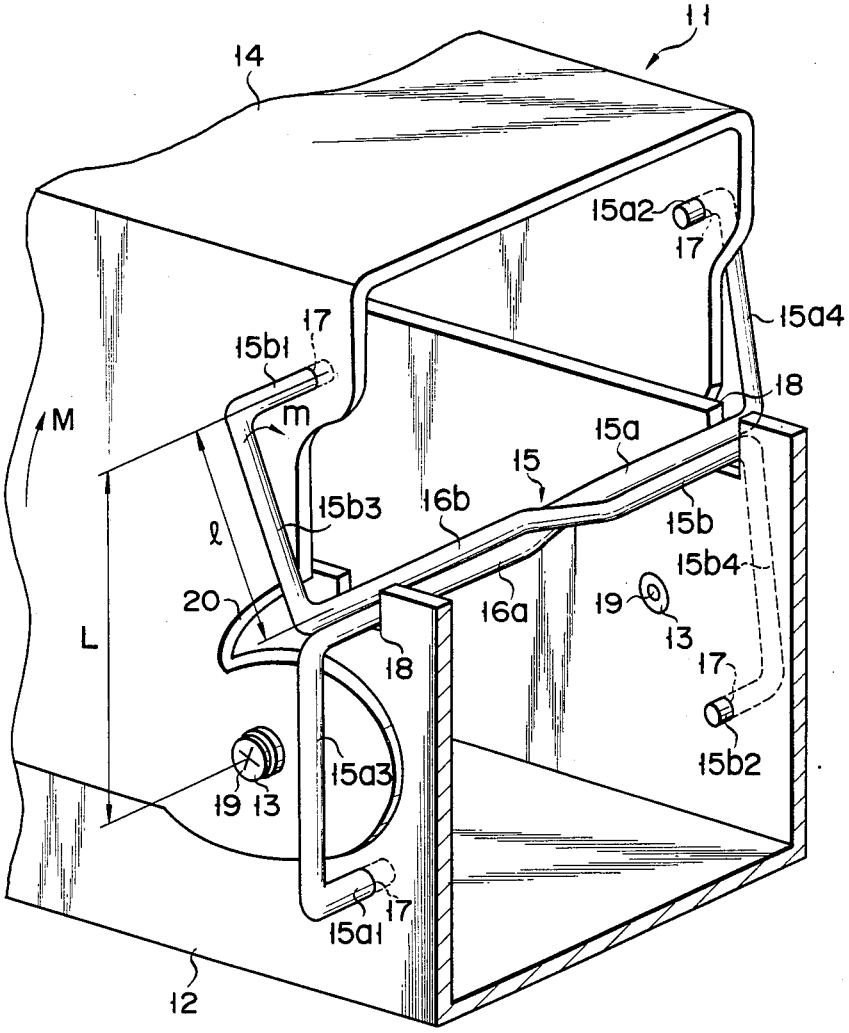
FIG. 2 is a schematic perspective view of a copying machine according to an embodiment of the present invention showing a state wherein its upper casing block is closed.

Paper sheets (image forming media) P are taken out one by one from either upper or lower paper cassette 25*a* or 25*b* by paper-supply roller 45 or 46. Each delivered sheet P is guided to a pair of aligning rollers 49 through paper guide path 47 or 48. Then, it is fed to a transfer region defined between drum 10 and transfer charger 50 by rollers 49. Cassettes 25*a* and 25*b* are removably attached to the lower right end portion of housing 31. Cassette 25*a* or 25*b* is selected by operating one of cassette selection keys on control panel 60. Sheet P delivered to the transfer region comes intimately into contact with the surface of photosensitive drum 40 when it reaches transfer charger 50. In this state, charger 50 transfers the toner image on drum 40 onto sheet P. After the transfer, sheet P is electrostatically separated from drum 40 by separation charger 51. Thereafter, it is fed to a pair of fixing rollers 53 at the terminal end side of conveyor belt 52 by he belt. As sheet P passes between fixing rollers 53, the transferred image is fixed on the sheet. After the fixation, sheet P is discharged onto tray 55 outside housing 31 by a pair of exit rollers 54. After the transfer process, moreover, the surface of photosensitive drum 40 is de-electrified by de-electrification charger 54, and the toner remaining on the surface is then removed by cleaner 57. Thereafter, a residual latent image on drum 40 is erased by discharge lamp 58. Thus, drum 40 is restored to its initial state. In FIG. 2, numeral 59 designates a cooling fan for preventing the temperature inside housing 31 from rising.

An embodiment of the present invention will now be described in detail, with reference to FIGS. 2 and 3.

Figure 3:
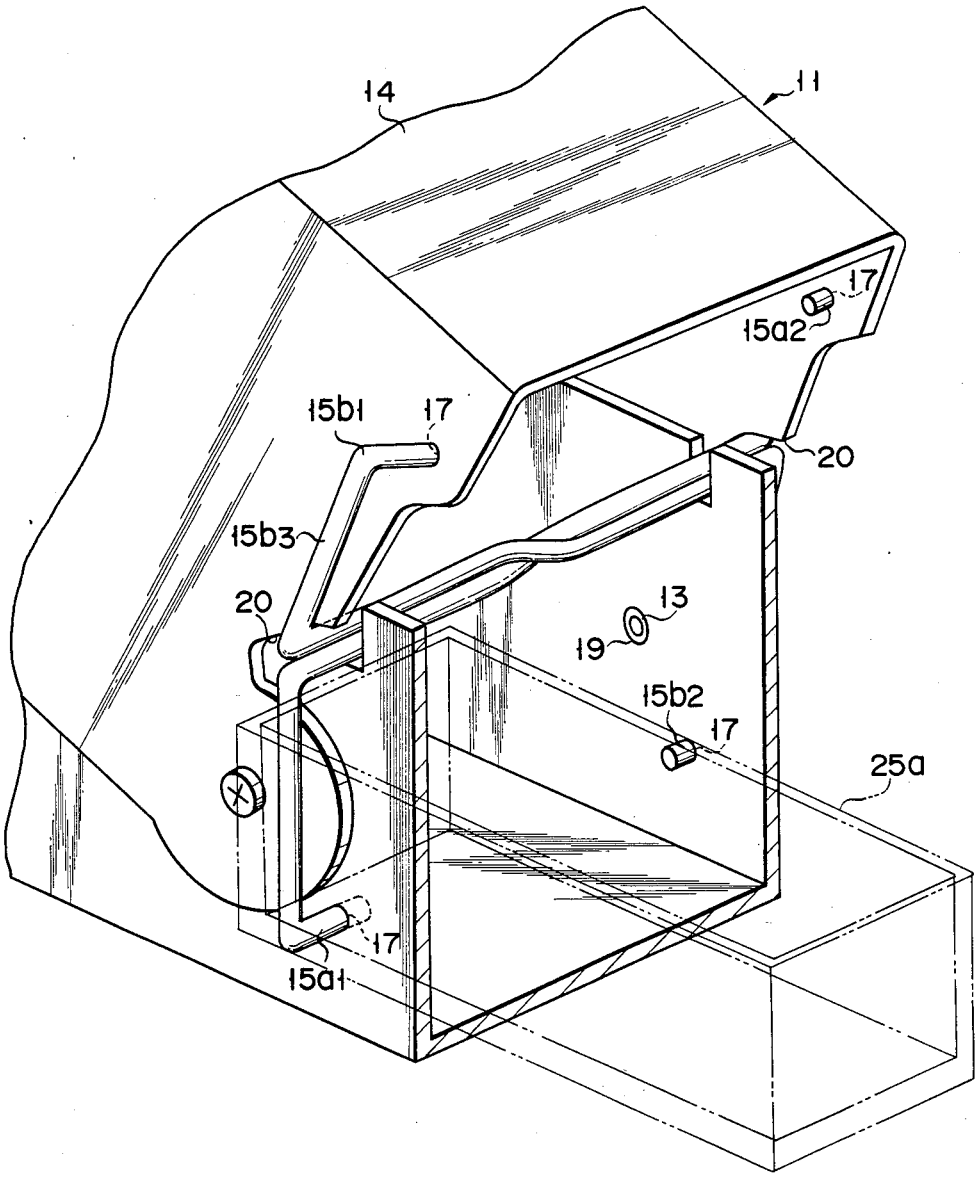
FIG. 3 is a schematic perspective view of the copying machine of FIG. 2 showing a state wherein the upper casing block is opened.

In FIGS. 2 and 3, numeral 11 designates a clamshell casing. Casing 11 comprises first or lower casing block 12 and second or upper casing block 14 swingably coupled thereto by means of coupling members 13.

Torsion bar means 15 is provided at the respective pivotal end portions of upper and lower casing blocks 14 and 12 connected by means of coupling members 13. Bar means 15 normally urges casing block 14 to swing away from casing block 12 (see FIG. 2).

Torsion bar means 15 is formed individually of two torsion rods **15*a* and 15*b*, which are twisted together in the same direction so that twist portions 16*a* and 16*b* at their respective middle sections overlap each other. One end portion 15*a*1 of rod 15*a* engages one of apertures 17 which are formed individually as engagement portions in side walls of lower casing block 12. The other end portion 15*a*2 of rod 15*a* engages one of aperture 17' which are formed individually as engagement portions in side walls of lower casing block 12. Likewise, one end portion 15*b*1 of torsion rod 15*b* engages the other of those apertures 17' in the side walls of upper casing block 14. The other end portion 15*b*2 of rod 15*b* engages the other of those apertures 17 in the side walls of lower casing block 12. Thus, the two opposite end portions of each of torsion rods 15*a* and 15*b* engage their corresponding apertures 17 and 17' of lower and upper casing blocks 12 and 14 so that rods 15*a* and 15*b* are twisted together. Both side end portions of twist portions 16*a* and 16*b* of torsion rods 15*a* and 15*b* are passed through and held by notches 18, which are formed individually in the open edge portions of lower casing block 12, at the upper end thereof. Therefore, the positions at which torsion bar means 15 is passed through notches of block 12 are deviated from pivotal points 19 of casing 11. Thus, torsion bar means 15 is located so that a wide space can be maintained inside lower casing block 12 without regard to the positions of points 19. Notches 20 are cut individually in both side wall portions of upper casing block 14 such that block 14 can avoid interfering with torsion bar means 15**.

Upper casing block 14 s urged continuously, by the restoring force of torsion bar means 15, in a direction such that it swings up. This, casing block 14 can be lifted from lower casing block 12, as shown in FIG. 3, by releasing a lock mechanism (not shown) which is used to fix the free end side of block 14.

At this time, the moment urging upper casing block 14 to be lifted can take a value which is obtained by multiplying the value of the torsional moment of torsion bar means 15 by a value which is obtained by dividing the distance between each pivotal point 19 of casing 11 and its corresponding point of action of bar means 15 (position of each engagement portion or aperture 17) by the length of each of arm portions **15*a*3, 15*a*4, 15*b*3 and 15*b*4 of bar means 15**.

In other words, it is possible to produce a moment given by $M = L/l \cdot m$, where M is the moment urging the upper casing block to be lifted, m is the torsional moment of the torsion bar means, L is the distance between each pivotal point of the casing and its corresponding point of action of the torsion bar means, and 1 is the length of each arm portion.

Moment M produces an urging force much greater than the one produced by only torsional moment m of the conventional torsion bar means. Such a large urging force can be obtained because the positions of twist portions **16*a* and 16*b* are deviated from those of pivotal points 19 of casing 11. For the same reason, moreover, torsion bar means 15 can be arranged on casing 11 so that the space inside lower casing block 12** is wide enough.

Consequently, as shown in FIG. 3, cassette **25*b* for the coping machine can be inserted and removed easily and smoothly through the internal space of the casing blocks 14, 12. Also, the restrictions on the shape and capacity of imaging means, including the trays 25** and the like, can be eased.

Figure 4A:
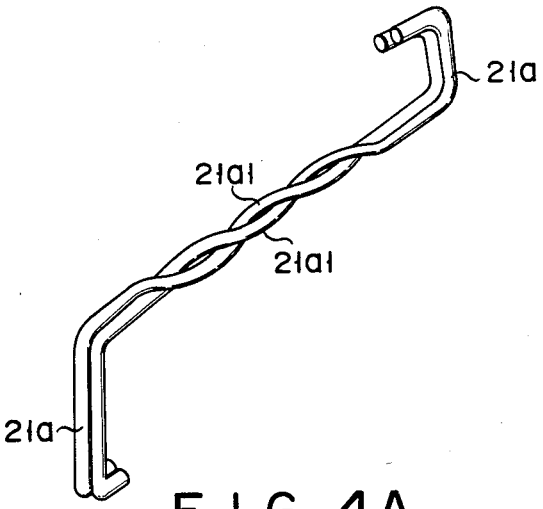
FIGS. 4A and 4B are perspective views showing different modifications of the torsion bar used in a casing pivoting mechanism of the copying machine of the invention.
Figure 4B:
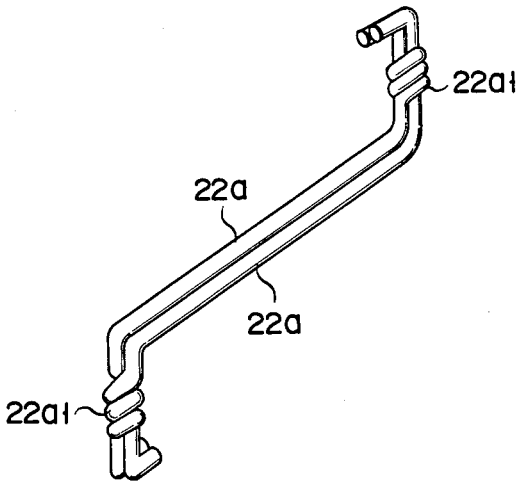

In the embodiment described above, torsion bar means 15 is formed of two relatively thick torsion rods **15*a* and 15*b* which are twisted together. Alternatively, however, the torsion bar means may be formed of a plurality of pairs of torsion rods 21*a* twisted together at their respective strand portions 21*a*1, as shown in FIG. 4A. As shown in FIG. 4B, moreover, the torsion bar means may be formed of a plurality of pairs of torsion rods 22*a* having strand portions 22*a*1** at their respective arm portions.

With use of the torsion bar means formed of the two or more pairs of torsion rods, as shown in FIGS. 4A and 4B, the torsional spring constant can be lowered. The torsional spring constant is in proportion to the fourth power of the diameter of each torsion rod **21*a* or 22*a*. By suitably setting the number of torsion rods 21*a* or 22*a* and the number of combinations of the rods twisted together, therefore, the force to lift upper casing block 14 can be adjusted so that it varies only little when block 14 is swung up and down. Thus, upper casing block 14** can be lifted and put on smoothly.

It is to be understood that the present invention is not limited to the embodiments described above, and that various changes and modifications may be effected therein by one skilled in the art without departing from the scope or spirit of the invention.

What is claimed is:

1. A casing pivoting mechanism for a copying machine, comprising:

a first casing block;

a second casing block swingably coupled to the first casing block; and torsion bar means mounted between the first and second casing blocks, so as to urge the second casing block in a predetermined direction with respect to the first casing block, pivotal points of said first and second casing blocks being situated away from positions at which the torsion bar means passes through the first and second casing blocks, said torsion bar means being formed by twisting at least two torsion rods together at the middle portions thereof, one and the other end portions of one of said torsion rods engaging first engagement portions of the first and second casing blocks, respectively, and one and the other end portions of the other of said torsion rods engaging second engagement portions of the first and second casing blocks, respectively.

2. The casing pivoting mechanism for a copying machine according to claim 1, wherein said torsion bar means includes a plurality of pairs of torsion rods twisted together at the middle portions thereof, so that the respective twist portions of each said set of torsion rods overlap each other.

* * * * *